US009746282B1

(12) United States Patent
Huang et al.

(10) Patent No.: US 9,746,282 B1
(45) Date of Patent: Aug. 29, 2017

(54) BUTTSTOCK FOR A BUFFER TUBE

(71) Applicant: Battle Arms Development, Inc., Henderson, NV (US)

(72) Inventors: George Huang, Henderson, NV (US); Jeffrey S. Cross, Lexington, TN (US)

(73) Assignee: Battle Arms Development, Inc., Henderson, NV (US)

( * ) Notice: Subject to any disclaimer, the term of this patent is extended or adjusted under 35 U.S.C. 154(b) by 9 days.

(21) Appl. No.: 15/000,953

(22) Filed: Jan. 19, 2016

Related U.S. Application Data

(60) Provisional application No. 62/105,087, filed on Jan. 19, 2015.

(51) Int. Cl.
*F41C 23/00* (2006.01)
*F41C 23/20* (2006.01)

(52) U.S. Cl.
CPC ..... *F41C 23/20* (2013.01)

(58) Field of Classification Search
CPC ..... F41C 23/00; F41C 23/08; F41C 23/20
USPC ..... D22/108, 111
See application file for complete search history.

(56) References Cited

U.S. PATENT DOCUMENTS

| | | | | |
|---|---|---|---|---|
| 7,398,616 | B1 * | 7/2008 | Weir | F41C 23/04 42/71.01 |
| 7,793,453 | B1 * | 9/2010 | Sewell, Jr. | F41C 23/04 42/73 |
| 8,186,090 | B1 * | 5/2012 | Chiarolanza | F41C 23/04 42/73 |
| 8,984,791 | B1 * | 3/2015 | Leslie | F41C 23/04 42/71.01 |
| 9,261,324 | B1 * | 2/2016 | Liang | F41C 23/04 |
| 2005/0115134 | A1 * | 6/2005 | Bond | F41C 23/08 42/74 |
| 2013/0180148 | A1 * | 7/2013 | Rogers | F41C 23/04 42/73 |
| 2016/0153742 | A1 * | 6/2016 | Copeland | F41C 23/00 42/72 |

* cited by examiner

*Primary Examiner* — Gabriel Klein
(74) *Attorney, Agent, or Firm* — Shaddock Law Group, PC

(57) ABSTRACT

A buttstock having a buttplate that comprises a partial hollow cylinder extending from a surface of the buttplate; a static arm extending from a first portion of the partial hollow cylinder; a dynamic arm extending from a second portion of the partial hollow cylinder, wherein the static arm is separated from the dynamic arm by a compression gap, wherein the dynamic arm can be urged toward the static arm; and an at least partially threaded static arm aperture formed through said static arm and aligned with a dynamic arm aperture formed through said dynamic arm.

20 Claims, 10 Drawing Sheets

BUTTSTOCK FOR A BUFFER TUBE

CROSS-REFERENCE TO RELATED APPLICATIONS

This patent application claims the benefit of U.S. Patent Application Ser. No. 62/105,087, filed Jan. 19, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to a buttstock adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position buttstock 10 that is slidable and lockable at various positions along a buffer tube 20. A typical variable position buttstock 10 can be locked into a collapsed position, as illustrated in FIG. 1, or locked into a fully extended position, as illustrated in FIG. 2.

As further illustrated in FIGS. 3 and 4, the typical mill-spec buffer tube 20 includes a capped cylindrical portion 22 having a threaded portion 23 for installation into a firearm receiver. Typically, an endplate 30 and a lock ring 40 are utilized to complete installation of the buffer tube 20 on the receiver. A key protrusion 25 extends from the cylindrical portion 22, typically at the 6 o'clock position. An interior portion of the key protrusion 25 includes a plurality of spaced apart recesses or apertures that interact with a retractable bolt to lock the buttstock 10 in a desired position relative to the buffer tube 20.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical buttstock can be relatively heavy and cumbersome and some users do not need the variable positioning in certain situations. Unfortunately, there does not currently exist a buttstock that can be easily fitted to the existing buffer tube that provides a lightweight, non-collapsible buttstock for the firearm.

The disadvantages and shortcomings of the prior art are overcome by the features and elements of the buttstock of the present invention. The advantages of the present invention are attained by providing a buttstock that comprises substantially planar buttplate extending from a first end to a second end. A partial hollow cylinder extends proximate the first end of the buttplate. A dynamic arm and a static arm extend from the partial hollow cylinder and are separated by a gap. The static arm also extends from a portion of the buttplate, while the dynamic arm is separated from the buttplate by a cut. Together, the partial hollow cylinder, the dynamic arm, and the static arm define an at least partially collapsible bore having an at least partially collapsible keyway.

An at least partially threaded aperture is formed through the static arm and is aligned with a dynamic arm aperture formed through the dynamic arm. The static arm aperture and the dynamic arm aperture are aligned such that a screw can be inserted through the dynamic arm aperture and threadedly received within the static arm aperture.

As the screw threadedly engages the threaded portion of the static arm aperture, the distance provided by the gap is reduced, the dynamic arm is flexed inward, toward the static arm, and at least a portion of the bore and keyway are collapsed, reducing the size of the bore and keyway.

In various exemplary, nonlimiting embodiments, a quick detachable mounting point is formed in a mounting mound, formed proximate the second end of the buttplate.

In certain exemplary, nonlimiting embodiments, a rear face of the buttstock includes a textured surface, which provides a nonslip or slip resistant rear face to the buttstock.

In various exemplary, nonlimiting embodiments the buttstock of the present disclosure comprises a buttplate having a partial hollow cylinder extending from a surface of the buttplate; a static arm extending from a first portion of the partial hollow cylinder; a dynamic arm extending from a second portion of the partial hollow cylinder, wherein the dynamic arm is separated from at least a portion of the buttplate by a recess or cut, wherein the static arm is separated from the dynamic arm by a compression gap, wherein the dynamic arm can be urged toward the static arm, and wherein if the dynamic arm is urged toward the static arm, a distance provided between the static arm and the dynamic arm by said compression gap is reduced; wherein at least portions of the partial hollow cylinder, the static arm, and the dynamic arm define and at least partially collapsible bore recess and an at least partially collapsible keyway; an at least partially threaded static arm aperture formed through said static arm and aligned with a dynamic arm aperture formed through said dynamic arm; and a screw or other fastener inserted through said dynamic arm aperture, spanning said compression gap, and at least partially threadedly received within said static arm aperture, such that as said screw at least partially threadedly engages at least a portion of said threaded portion of said static arm aperture, said dynamic arm is forced to flex inward, toward said static arm, reducing said distance provided by said compression gap.

In various exemplary, nonlimiting embodiments the buttstock of the present disclosure comprises a buttplate having a partial hollow cylinder extending from a surface of the buttplate; a static arm extending from a first portion of the partial hollow cylinder; a dynamic arm extending from a second portion of the partial hollow cylinder, wherein the static arm is separated from the dynamic arm by a compression gap, wherein the dynamic arm can be urged toward the static arm; and an at least partially threaded static arm aperture formed through said static arm and aligned with a dynamic arm aperture formed through said dynamic arm.

Accordingly, the presently disclosed invention separately provides an improved buttstock for firearms.

The presently disclosed invention separately provides an improved buttstock for firearms, which can be easily retrofitted to a currently installed buffer tube.

The presently disclosed invention separately provides an improved buttstock for firearms, which can be easily removed from a currently installed buffer tube.

The presently disclosed invention separately provides an improved buttstock for firearms, which interacts with a standard buffer tube and buffer tube key protrusion so as not to rotate relative to the buffer tube.

The presently disclosed invention separately provides an improved buttstock for firearms, which provides a simplified, lightweight buttstock solution for a firearm.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

For simplicity and clarification, the design factors and operating principles of the buttstock according to this invention are explained with reference to various exemplary embodiments of a buttstock according to this invention. The basic explanation of the design factors and operating principles of the buttstock is applicable for the understanding, design, and operation of the buttstock of this invention. It should be appreciated that the buttstock can be adapted to many applications where a buttstock can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "buttstock", "buttplate", and "buffer tube" are used for basic explanation and understanding of the operation of the systems, methods, and apparatuses of this invention. Therefore, the terms "buttstock", "buttplate", and "buffer tube" are not to be construed as limiting the systems, methods, and apparatuses of this invention.

For simplicity and clarification, the buttstock of this invention will be described as being used in conjunction with a buffer tube. However, it should be appreciated that these are merely exemplary embodiments of the buttstock and are not to be construed as limiting this invention. Thus, the buttstock of this invention may be utilized in conjunction with any mil-spec, commercial, or other buffer tube variant.

Figure 1:
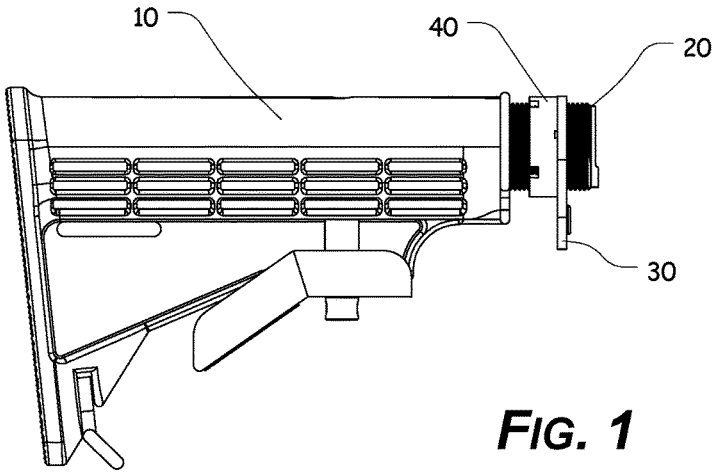
FIG. 1 PRIOR ART
FIG. 1 illustrates a side view of a standard, AR-15 or M4 style collapsible buttstock, shown in a collapsed position relative to a buffer tube.
Figure 2:
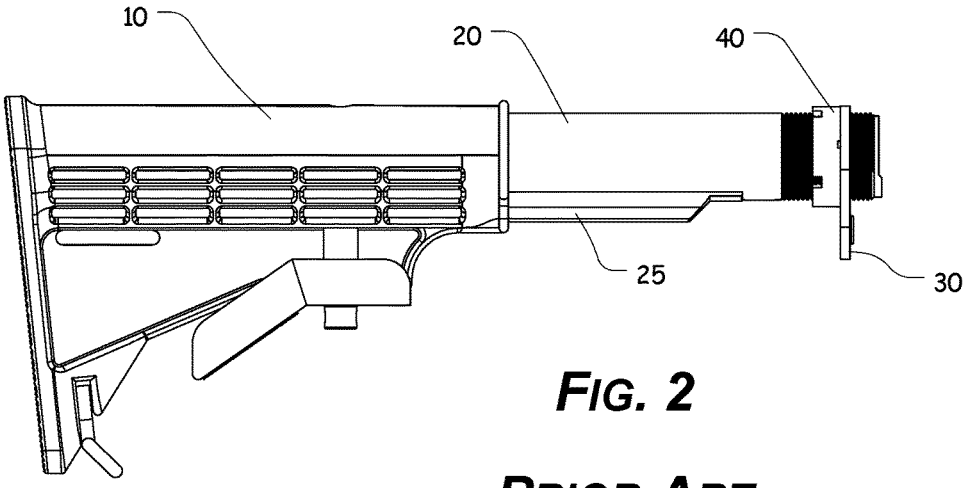
FIG. 2 PRIOR ART
FIG. 2 illustrates a side view of a standard, AR-15 or M4 style collapsible buttstock, shown in an extended position relative to a buffer tube.
Figure 3:
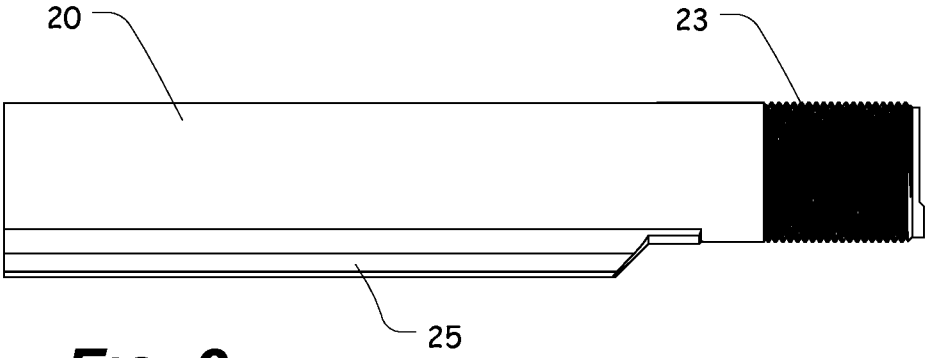
FIG. 3 PRIOR ART
FIG. 3 illustrates a side view of a standard, buffer tube.
Figure 4:
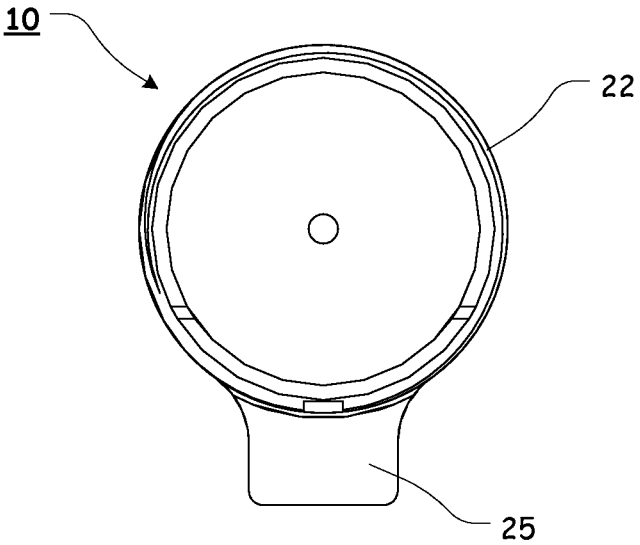
FIG. 4 PRIOR ART
FIG. 4 illustrates a front view of a standard, buffer tube.
Figure 5:
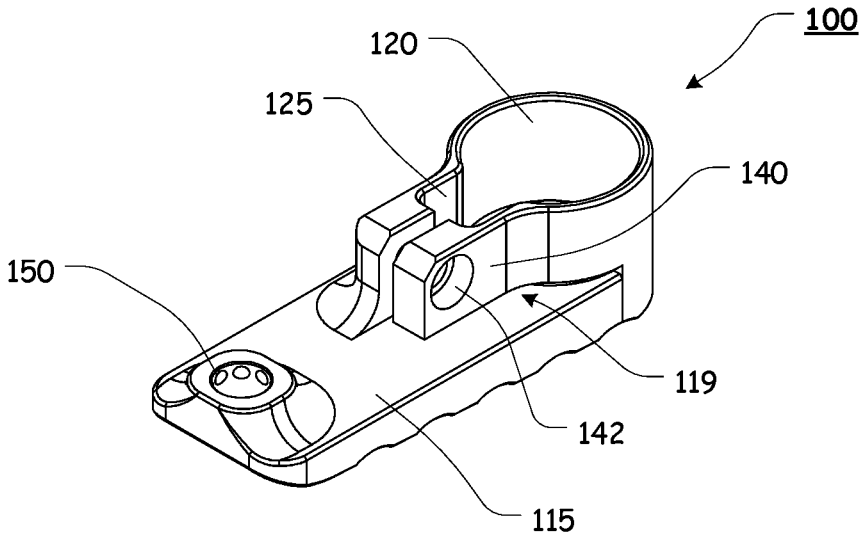
FIG. 5 illustrates a first, front perspective view showing the components of an exemplary embodiment of a buttstock, according to this invention.
Figure 6:
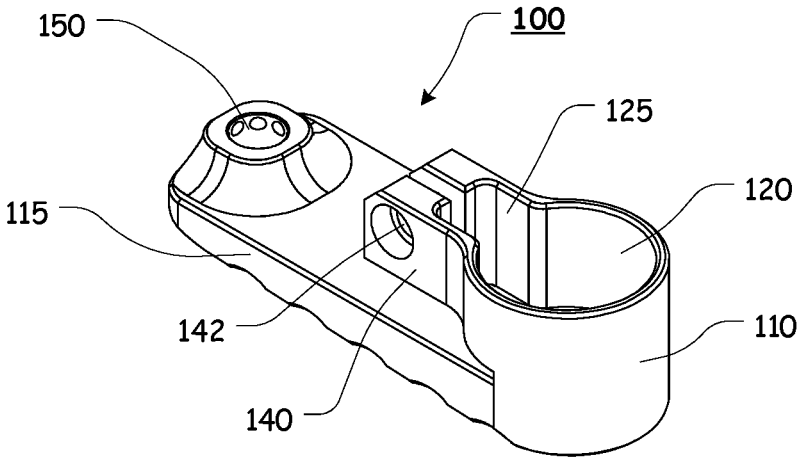
FIG. 6 illustrates a second, front perspective view showing the components of an exemplary embodiment of a buttstock, according to this invention.
Figure 7:
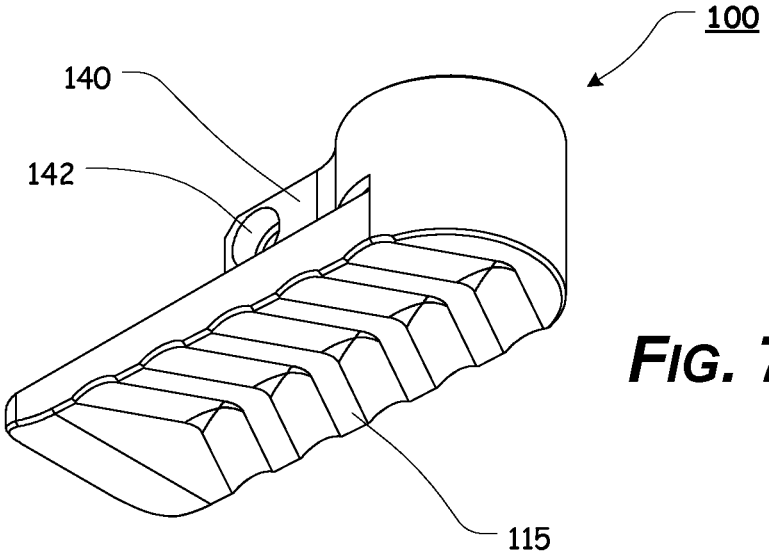
FIG. 7 illustrates a first, rear perspective view showing the components of an exemplary embodiment of a buttstock, according to this invention.
Figure 8:
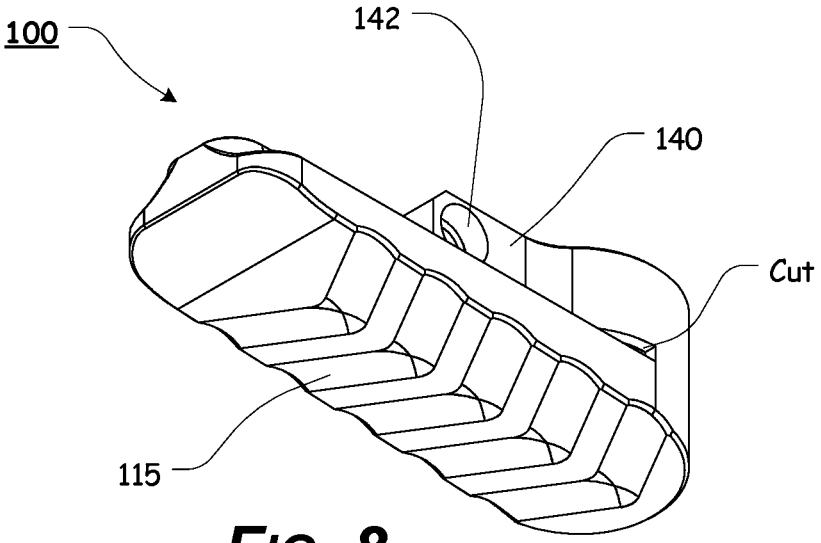
FIG. 8 illustrates a second, rear perspective view showing the components of an exemplary embodiment of a buttstock, according to this invention.
Figure 9:
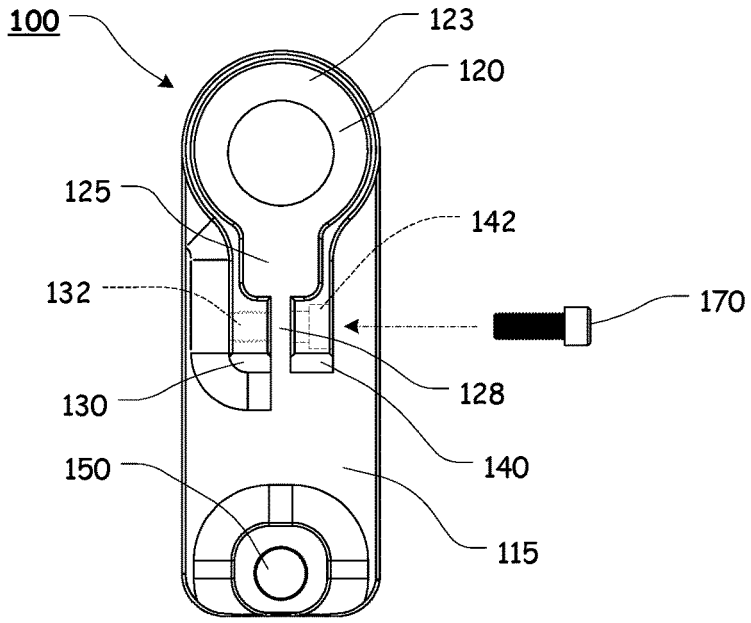
FIG. 9 illustrates a front view showing the components of an exemplary embodiment of a buttstock, according to this invention.
Figure 10:
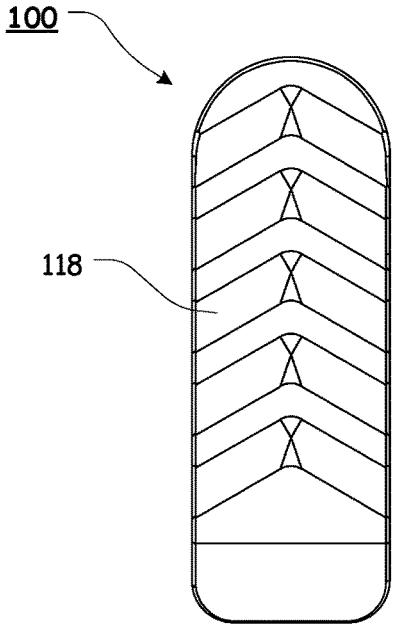
FIG. 10 illustrates a rear view showing the components of an exemplary embodiment of a buttstock, according to this invention.
Figure 11:
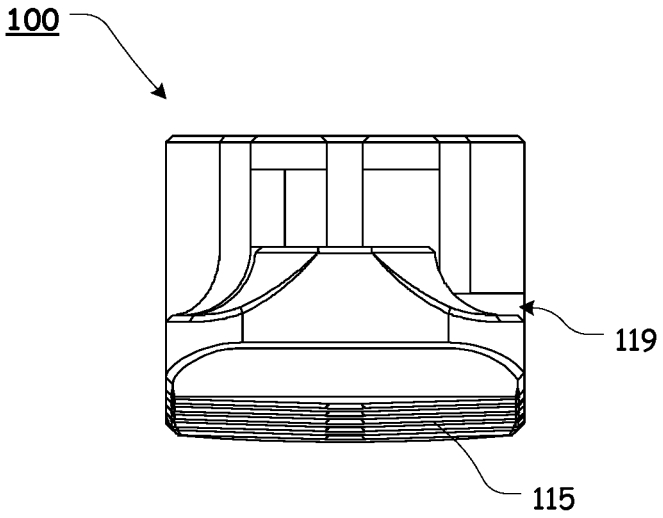
FIG. 11 illustrates a top view showing the components of an exemplary embodiment of a buttstock, according to this invention.
Figure 12:
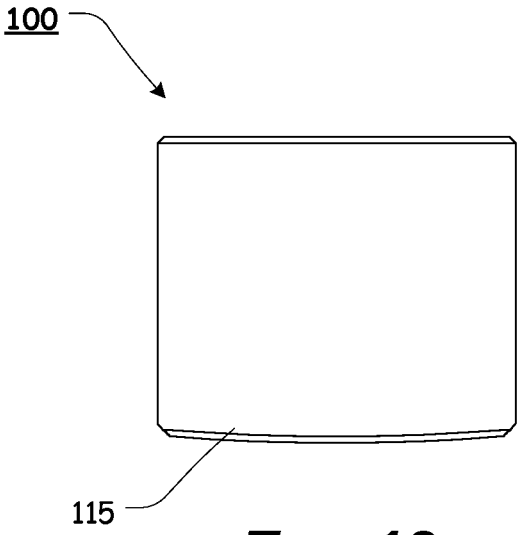
FIG. 12 illustrates a bottom view showing the components of an exemplary embodiment of a buttstock, according to this invention.
Figure 13:
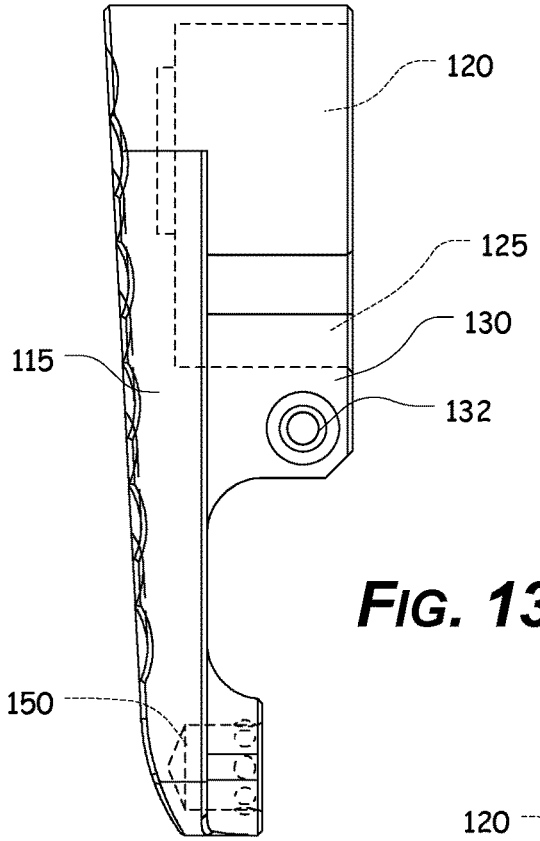
FIG. 13 illustrates a left side view showing the components of an exemplary embodiment of a buttstock, according to this invention.
Figure 14:
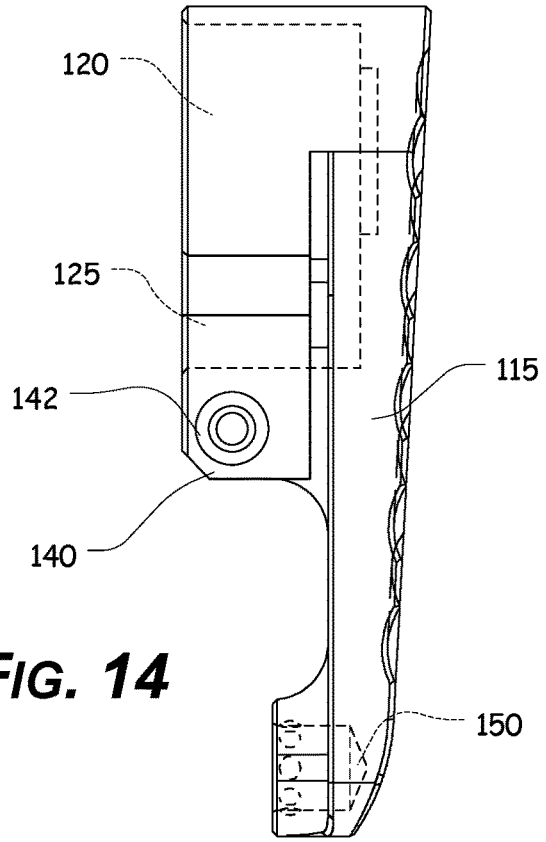
FIG. 14 illustrates a right side view showing the components of an exemplary embodiment of a buttstock, according to this invention.
Figure 15:
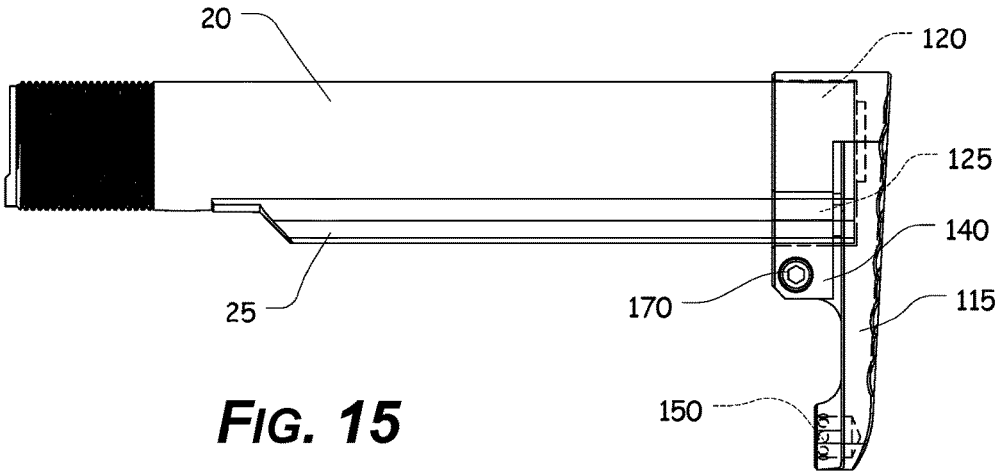
FIG. 15 illustrates a right side view showing an exemplary embodiment of a buttstock secured to a buffer tube, according to this invention.
Figure 16:
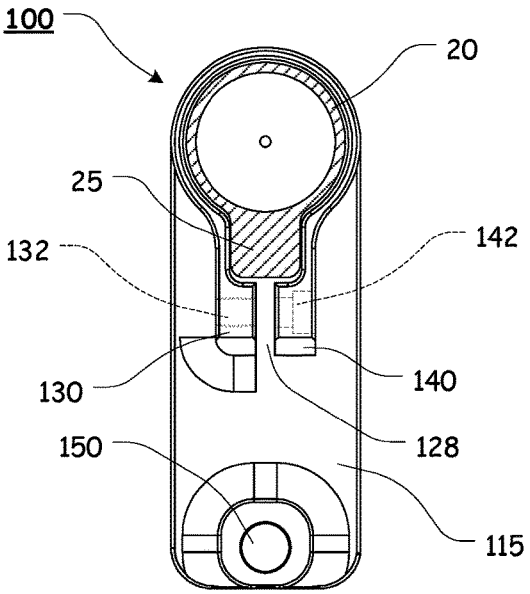
FIG. 16 illustrates a front view showing an exemplary embodiment of a buttstock secured to a buffer tube, according to this invention.
Figure 17:
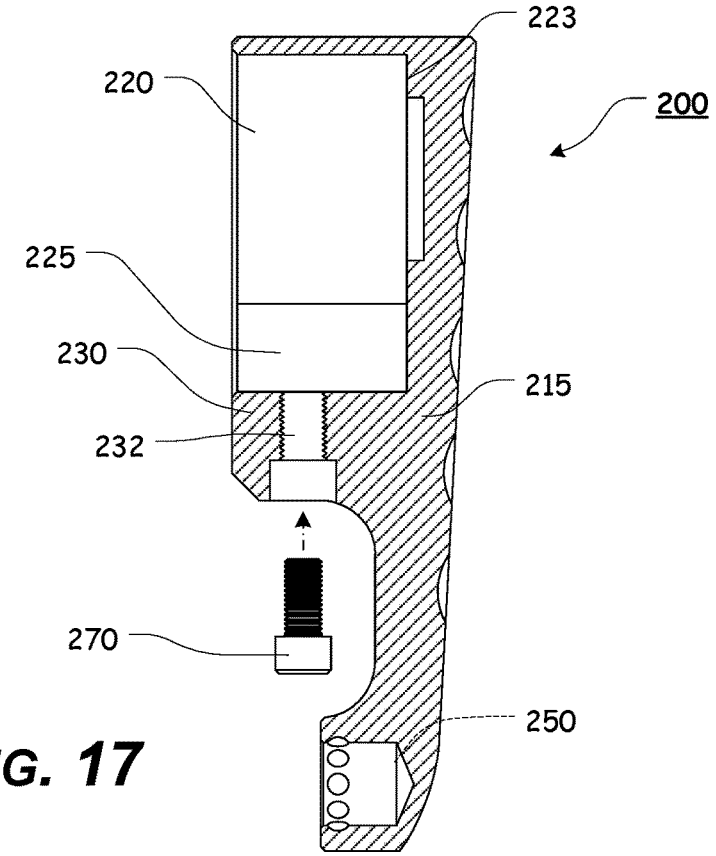
FIG. 17 illustrates a right side, cross-sectional view showing the components of an exemplary embodiment of a buttstock, according to this invention.
Figure 18:
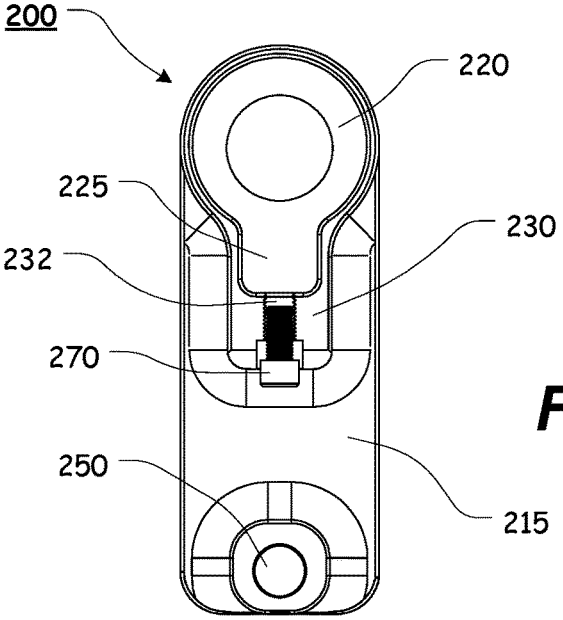
FIG. 18 illustrates a front view showing the components of an exemplary embodiment of a buttstock, according to this invention.
Figure 19:
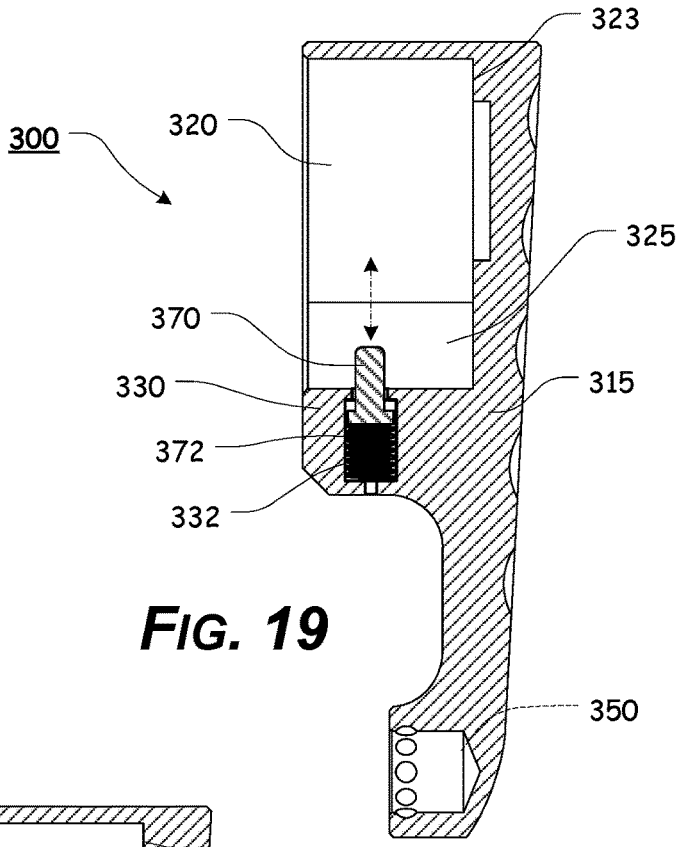
FIG. 19 illustrates a right side, cross-sectional view showing the components of an exemplary embodiment of a buttstock, according to this invention.
Figure 20:
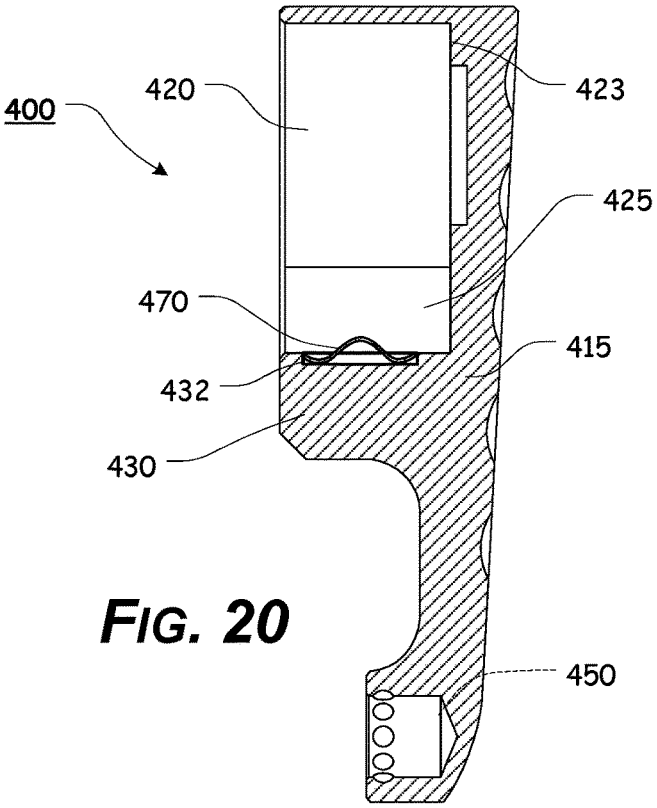
FIG. 20 illustrates a right side, cross-sectional view showing the components of an exemplary embodiment of a buttstock, according to this invention.

Turning now to the drawing FIGS., as outlined above, FIGS. 1-4 illustrate various components of known buttstocks and buffer tubes. FIGS. 5-16 illustrate various elements and/or aspects of an exemplary embodiment of the buttstock 100, according to this invention. More specifically, FIGS. 5-14 illustrate certain elements and/or aspects of an exemplary embodiment of the buttstock 100, while FIGS. 15-16 illustrate the exemplary embodiment of the buttstock 100 installed on an exemplary buffer tube 20. FIGS. 17-18 illustrate an exemplary embodiment of a buttstock 200, FIG. 19 illustrates an exemplary embodiment of a buttstock 300, and FIG. 20 illustrates an exemplary embodiment of a buttstock 400.

As illustrated, in various exemplary, nonlimiting embodiments, the buttstock 100 of the present invention comprises a buttplate 115 having a partial hollow cylinder 110, a static arm 130, and a dynamic arm 140 defining an at least partially collapsible bore recess 120 having an at least partially collapsible keyway 125.

In various exemplary embodiments, the buttplate 115 comprises a substantially planar portion of material extending from a first end to a second end. The partial hollow cylinder 110 extends from the buttplate 115, proximate the first end of the buttplate 115. In various exemplary embodiments, the partial hollow cylinder 110 is formed integral to the buttplate 115. Alternatively, the partial hollow cylinder 110 comprises a separate component that is attached or coupled to the buttplate 115.

The static arm 130 extends from the partial hollow cylinder 110 and may be formed as an integral component and extension of the buttplate 115 or may comprise a separate component that is formed as an integral component and extension of the partial hollow cylinder 110.

The dynamic arm 140 also extends from the partial hollow cylinder 110 and may be formed as an integral component and extension of the partial hollow cylinder 110. The dynamic arm 140 is separated from at least a portion of the buttplate 115 by a recess or cut 119, which separates the dynamic arm 140 from the buttplate 115.

The static arm 130 and the dynamic arm 140 extend from substantially opposing sides of the partial hollow cylinder 110 and are separated by a compression gap 128. While the dynamic arm 140 is relatively rigid, since the dynamic arm 140 is separated from at least a portion of the buttplate 115 by the cut 119, the dynamic arm 140 can be urged toward the static arm 130, reducing the compression gap 128 between the static arm 130 and the dynamic arm 140.

An at least partially threaded static arm aperture 132 is formed through the static arm 130 and is aligned with a dynamic arm aperture 142 formed through the dynamic arm 140. In various exemplary embodiments, the dynamic arm aperture 142 is a compound aperture having an initial, recessed portion for receiving at least a portion of a head of the screw or other fastener 170. The static arm aperture 132 and the dynamic arm aperture 142 are aligned such that the screw or other appropriate fastener 170 can be inserted through the dynamic arm aperture 142, spanning the compression gap 128, and threadedly received within the static arm aperture 132.

As the screw or fastener 170 threadedly engages the threaded portion of the static arm aperture 132, the dynamic arm 140 is forced to flex inward, toward the static arm 130, reducing the distance provided by the compression gap 128. As the distance provided by the compression gap 128 is reduced, at least a portion of the bore recess 120 and keyway 125 are collapsed, reducing the inner diameter of the bore recess 120 and the width of the keyway 125, providing a clamping force to the bore recess 120 and keyway 125.

When taken together, portions of the partial hollow cylinder 110, the dynamic arm 140, and the static arm 130 define various walls that delineate an at least partially collapsible bore recess 120 having an at least partially collapsible keyway 125 that extends from the bore recess 120. The compound aperture or recess formed by the bore recess 120 and the extending keyway 125 is sized so as to accept at least a portion of the rear of a buffer tube 20 within the compound recess, with the main cylindrical portion 22 of the buffer tube 20 fitting within the bore recess 120 and the key protrusion 25 fitting within the keyway 125. Typically, the buffer tube 20 slides into the compound recess until the terminating end surface of the buffer tube 20 contacts the bottom wall 123 of the compound aperture.

Once the buffer tube 20 is positioned within the bore recess 120 and keyway 125, the screw or fastener 170 may be tightened, reducing the compression gap 128 between the static arm 130 and the dynamic arm 140 (as well as the inner diameter of the bore recess 120 and the width of the keyway 125) and providing a clamping force to the exterior of the buffer tube 20.

Because the main cylindrical portion 22 of the buffer tube 20 is fitted within the bore recess 120 and the key protrusion 25 is fitted within the keyway 125, when the buttstock 100 is clamped to the buffer tube 20, the interaction of the keyway 125 and key protrusion 25 eliminates rotation of the buttstock 100 relative to the buffer tube 20 and maintains the buttstock 100 in a desired orientation relative to the buffer tube 20.

In various exemplary, nonlimiting embodiments, an optional quick detachable mounting point 150 is formed in a mounting protrusion or mound, formed proximate the second end of the buttplate 115. The optional quick detachable mounting point 150 comprises a substantially cylindrical recess or aperture extending into the mounting protrusion. In certain exemplary embodiments, a plurality of dimples are formed around an inner wall of the optional quick detachable mounting point 150. In this manner, a quick detachable mount (such as, for example, a quick detachable or "QD" sling mount) can be releasably positioned within the optional quick detachable mounting point 150 and frictionally engaged at a desired position. Alternatively, a channel or recess is formed around the entire inner wall of the optional quick detachable mounting point 150 such that a QD" sling mount can be releasably positioned within the optional quick detachable mounting point 150 and frictionally engaged so as to freely rotate about the optional quick detachable mounting point 150.

In certain alternative embodiments, the optional quick detachable mounting point 150 is formed in the buttplate 115 itself and not formed in a mounting protrusion or mound. In these exemplary embodiments, the optional quick detachable mounting point 150 may be formed with a bottom wall 123 or may comprise a sling attachment aperture that is formed through both side walls of the buttplate 115, which provides an aperture for attaching or coupling a sling or sling attachment devices.

In certain exemplary, nonlimiting embodiments, the rear face 118 of the buttstock 100 includes a textured surface, which provides a nonslip or slip resistant rear face 118 to the buttstock 100. By providing a nonslip or slip resistant rear face 118, the buttstock 100 provides increased purchase for the buttstock 100 when positioned against an object, such as, for example, clothing.

In various exemplary embodiments, various components of the buttstock 100 are substantially rigid and are formed of aluminum. Alternate materials of construction of the various components of the buttstock 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the buttstock 100 is a design choice based on the desired appearance and functionality of the buttstock 100.

It should be appreciated that certain elements of the buttstock 100 may be formed as an integral unit (such as, for example, the buttplate 115 and the partial hollow cylinder 110). Alternatively, suitable materials can be used and sections or elements made independently and attached or coupled together, such as by adhesives, welding, screws, rivets, pins, or other fasteners, to form the various elements of the buttstock 100.

It should also be understood that the overall size and shape of the buttstock 100 and the various portions thereof is a design choice based upon the desired functionality and/or appearance of the buttstock 100.

It should also be appreciated that a more detailed explanation of the instructions regarding how to install the buttstock 100 are not provided herein because such background information will be understood by one of ordinary skill in the art, given the level of description provided herein. Therefore, it is believed that the level of description provided herein is sufficient to enable one of ordinary skill in the art to understand and practice the invention, as described.

FIGS. 17-18 illustrate certain elements and/or aspects of an exemplary embodiment of a buttstock 200, according to the present disclosure. As illustrated in FIGS. 17-18, the buttstock 200 comprises at least some of a buttplate 215 having a bore recess 220 with a bottom wall 223, a keyway 225, and an optional quick detachable mounting point 250.

The bore recess 220 and the extending keyway 225 form a compound recess that is sized so as to accept at least a portion of the rear of a buffer tube 20 within the compound recess, with the main cylindrical portion 22 of the buffer tube 20 fitting within the bore recess 220 and the key protrusion 25 fitting within the keyway 225. Typically, the buffer tube 20 slides into the compound recess until the terminating end surface of the buffer tube 20 contacts the bottom wall 223 of the compound aperture.

Once the buffer tube 20 is positioned within the bore recess 220 and keyway 225, a screw or fastener 270 threadedly inserted within an at least partially threaded support wall aperture 232 formed in a support wall 230. The at least partially threaded support wall aperture 232 leads into at least a portion of the compound recess, such that when the screw or fastener 270 is threaded within the at least partially threaded support wall aperture 232, at least a portion of the screw or fastener 270 enters into the compound recess to contact a surface of the exterior of the buffer tube 20. In this manner, the screw or fastener 270 may be tightened to provide a clamping force to the exterior of the buffer tube 20, to keep the buffer tube 20 from being removed from the compound recess formed by the bore recess 220 and the keyway 225.

Because the main cylindrical portion 22 of the buffer tube 20 is fitted within the bore recess 220 and the key protrusion 25 is fitted within the keyway 225, when the screw or fastener 270 is clamped to the buffer tube 20, the interaction of the keyway 225 and key protrusion 25 eliminates rotation of the buttstock 200 relative to the buffer tube 20 and maintains the buttstock 200 in a desired orientation relative to the buffer tube 20.

FIG. 19 illustrates certain elements and/or aspects of an exemplary embodiment of a buttstock 300, according to the present disclosure. The buttstock 300 comprises at least some of a buttplate 315 having a bore recess 320 with a bottom wall 323, a keyway 325, and an optional quick detachable mounting point 350. It should be understood that these components are similar to the components shown and described with reference to the buttstock 200 in FIGS. 17-18. However, the buttstock 300 further comprises a detent aperture 332 formed in a support wall 330. The detent aperture 332 is formed so as to at least partially capture a detent 370 that is spring biased by a detent spring 372, such that at least a portion of the detent 370 extends into the compound recess formed by the bore recess 320 and the keyway 325.

Once the buffer tube 20 is positioned within the bore recess 320 and keyway 325, the spring bias of the detent 370 can be overcome, urging the detent 370 at least out of the compound recess a sufficient distance to allow the buffer tube 20 to be slidably positioned within the compound recess until the terminating end surface of the buffer tube 20 contacts the bottom wall 323 of the compound aperture. Once appropriately positioned, the spring bias of the detent spring 372 urges at least a portion of the detent 370 into the compound recess to maintain the buffer tube 20 within the compound recess.

FIG. 20 illustrates certain elements and/or aspects of an exemplary embodiment of a buttstock 400, according to the present disclosure. The buttstock 400 comprises at least some of a buttplate 415 having a bore recess 420 with a bottom wall 423, a keyway 425, and an optional quick detachable mounting point 450. It should be understood that these components are similar to the components shown and described with reference to the buttstock 200 in FIGS. 17-18. However, the buttstock 400 further comprises a tensioning spring recess 432 formed in a support wall 430. The tensioning spring recess 432 is formed so as to at least partially receive a tensioning spring 470 that is spring biased such that at least a portion of the tensioning spring 470 extends into the compound recess formed by the bore recess 420 and the keyway 425.

Once the buffer tube 20 is positioned within the bore recess 420 and keyway 425, the spring bias of the tensioning spring 470 can be overcome, urging the tensioning spring 470 at least out of the compound recess a sufficient distance to allow the buffer tube 20 to be slidably positioned within the compound recess until the terminating end surface of the buffer tube 20 contacts the bottom wall 423 of the compound aperture. Once appropriately positioned, the spring bias of the tensioning spring 470 urges at least a portion of the tensioning spring 470 into the compound recess to maintain the buffer tube 20 within the compound recess.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A buttstock, comprising:

a buttplate, wherein said buttplate comprises a substantially planar portion of material extending from a first end to a second end;

a partial hollow cylinder having a static arm and a dynamic arm extending from said partial hollow cylinder, wherein at least portions of said partial hollow cylinder, said static arm, and said dynamic arm define a compound aperture having a bore and a keyway;

an at least partially threaded static arm aperture formed through said static arm and aligned with a dynamic arm aperture formed through said dynamic arm; and a screw or other fastener inserted through said dynamic arm aperture, spanning a gap between said dynamic arm and said static arm, and threadedly received within said static arm aperture, such that as said screw or other fastener threadedly engages said threaded portion of said static arm aperture, said dynamic arm is forced to flex inward, toward said static arm, reducing said distance provided by said gap.

2. The buttstock of claim 1, wherein said partial hollow cylinder extends from said buttplate, proximate said first end of said buttplate.

3. The buttstock of claim 1, wherein said static arm and said dynamic arm extend from substantially opposing sides of said partial hollow cylinder and are separated by a gap.

4. The buttstock of claim 1, wherein as said distance provided by said gap is reduced, at least a portion of said bore and keyway are collapsed, reducing an inner diameter of said bore and a width of said keyway, providing a clamping force to said bore and said keyway.

5. The buttstock of claim 1, wherein a rear face of the buttstock includes a textured surface.

6. A buttstock, comprising:

a buttplate having a partial hollow cylinder extending from a surface of the buttplate;

a static arm extending from a first portion of the partial hollow cylinder;

a dynamic arm extending from a second portion of the partial hollow cylinder, wherein the dynamic arm is separated from at least a portion of the buttplate by a recess or cut, wherein the static arm is separated from the dynamic arm by a compression gap, wherein the dynamic arm can be urged toward the static arm, and wherein if the dynamic arm is urged toward the static arm, a distance provided between the static arm and the dynamic arm by said compression gap is reduced;

wherein at least portions of the partial hollow cylinder, the static arm, and the dynamic arm define an at least partially collapsible bore recess and an at least partially collapsible keyway;

an at least partially threaded static arm aperture formed through said static arm and aligned with a dynamic arm aperture formed through said dynamic arm; and a screw or other fastener inserted through said dynamic arm aperture, spanning said compression gap, and at least partially threadedly received within said static arm aperture, such that as said screw or other fastener at least partially threadedly engages at least a portion of said threaded portion of said static arm aperture, said dynamic arm is forced to flex inward, toward said static arm, reducing said distance provided by said compression gap.

7. The buttstock of claim 6, wherein the buttplate comprises a substantially planar portion of material extending from a first end to a second end.

8. The buttstock of claim 6, wherein the static arm and the dynamic arm extend from substantially opposing sides of the partial hollow cylinder.

9. The buttstock of claim 6, wherein the partial hollow cylinder is formed integral to the buttplate.

10. The buttstock of claim 6, wherein the partial hollow cylinder is a separate component that is attached or coupled to the buttplate.

11. The buttstock of claim 6, wherein the partial hollow cylinder is formed as an integral component and extension of the buttplate.

12. The buttstock of claim 6, wherein the static arm comprises an integral component and extension of the partial hollow cylinder.

13. The buttstock of claim 6, wherein the dynamic arm is formed as an integral component and extension of the partial hollow cylinder.

14. The buttstock of claim 6, wherein if the compression gap is reduced, at least a portion of the bore recess and at least a portion of the keyway are collapsed, reducing an inner diameter of the bore recess and the width of the keyway.

15. The buttstock of claim 6, further comprising a quick detachable mounting point formed in the buttplate.

16. The buttstock of claim 6, wherein a rear face of the buttstock includes a textured surface.

17. A buttstock, comprising:

a buttplate having a partial hollow cylinder extending from a surface of the buttplate;

a static arm extending from a first portion of the partial hollow cylinder;

a dynamic arm extending from a second portion of the partial hollow cylinder, wherein the static arm is separated from the dynamic arm by a compression gap, wherein the dynamic arm can be urged toward the static arm; and an at least partially threaded static arm aperture formed through said static arm and aligned with a dynamic arm aperture formed through said dynamic arm.

18. The buttstock of claim 17, wherein if a screw or other fastener is inserted through said dynamic arm aperture, spanning said compression gap, and at least partially threadedly received within said static arm aperture, such that as said screw or other fastener threadedly engages at least a portion of said threaded portion of said static arm aperture, said dynamic arm is forced to flex inward, toward said static arm, reducing said distance provided by said compression gap.

19. The buttstock of claim 17, wherein at least portions of the partial hollow cylinder, the static arm, and the dynamic arm define an at least partially collapsible bore recess and an at least partially collapsible keyway.

20. The buttstock of claim 17, wherein if the dynamic arm is urged toward the static arm, a distance provided between the static arm and the dynamic arm by said compression gap is reduced.

* * * * *